US005415311A

United States Patent [19]

Coogan

[11] Patent Number: 5,415,311

[45] Date of Patent: May 16, 1995

[54] COLLAPSIBLE STORAGE CONTAINERS

[75] Inventor: James D. Coogan, Camden Park, Australia

[73] Assignee: Rees Operations Pty. Ltd., Australia

[21] Appl. No.: 232,516

[22] Filed: Apr. 22, 1994

[51] Int. Cl.[6] ..... B65D 21/02

[52] U.S. Cl. ..... 220/6; 220/1.5; 220/23.6; 206/600

[58] Field of Search ..... 220/6, 7, 1.5, 23.6; 206/600

[56] References Cited

U.S. PATENT DOCUMENTS

| | | | |
|---|---|---|---|
| 2,579,655 | 12/1951 | Donald | 220/6 |
| 3,529,741 | 9/1970 | Walker et al. | 220/7 |
| 4,162,737 | 7/1979 | Clive-Smith | 220/7 |
| 4,186,841 | 2/1980 | Buckley et al. | 220/6 |
| 4,662,532 | 5/1987 | Anderson et al. | 220/6 |
| 5,056,667 | 10/1991 | Coogan | 220/7 |
| 5,190,179 | 3/1993 | Richter et al. | 220/6 |

*Primary Examiner*—Stephen J. Castellano
*Attorney, Agent, or Firm*—Brown, Martin, Haller & McClain

[57] ABSTRACT

Improved collapsible storage container (10) of the type having a pallet base, front and rear gates (15, 16) hinged with respect to the base (11), a pair of opposed side panels (17, 18) also hinged with respect to the base (11), the base (11) having a stub corner post (12) at each of its four corners, wherein each said corner post (12) is provided with locating means (22) at its upper end arranged to engage and locate a corresponding bottom corner portion of the base of an adjacent container when stacked thereontop, and wherein each side panel (17, 18) is provided with cut out means (25) at each of its two bottom corners, which are shaped and dimensioned so as to allow the side panel to be folded upwardly, unobstructed by the locating means, to its erect condition.

9 Claims, 2 Drawing Sheets

COLLAPSIBLE STORAGE CONTAINERS

This invention relates to improvements to collapsible or folding storage containers, and is particularly concerned with an improved collapsible pallet cage of the type having a pallet base, front and rear gates which can either be hinged with respect to the base for folding inwardly thereonto or removably mounted with respect to the base in such a way that the gates can be lifted vertically upwards to disengage from their mountings and in turn laid flat on top of the pallet base, and a pair of opposed side panels hinged with respect to the base for folding inwardly thereonto, arranged and constructed so that the front and rear gates and the side panels, in their collapsed condition, lie in a flat condition on top of the pallet base.

It is of course well known for the pallet base of the container to be designed in such a way that it can receive the forks of a forklift truck to assist the handling thereof, in particular the raising and lowering of the containers for stacking or destacking purposes. It is desirable that storage containers be designed to easily stack whether in their erected or folded down condition, and regardless of whether the containers are of the same or different type.

Whilst various forms of collapsible storage containers are known to the applicant, they are not generally satisfactory and do not satisfy the above criteria.

It is the main object of the present invention to provide improvements to a collapsible storage container which will facilitate interstacking thereof, regardless of whether the container is in its collapsed or erected condition, and wherein the hinging movement of the side panels is not impaired.

It is a further object of the present invention to provide an improved collapsible storage container which is of extremely simple yet sturdy construction, and which allows the side panels to be quickly and easily folded to their collapsed position on top of the pallet base without having to bodily lift same.

Broadly according to this invention therefore, a collapsible storage container comprises a substantially rectangular support base having an horizontal floor, a stub corner post of angle section fixed vertically at each of the four corners of the support base, front and rear gates movably mounted with respect to the support base, a pair of opposed foldable rectangular side panels each being pivotally supported between a respective pair of said corner posts for pivotal movement about a fixed horizontal axis between an erect condition substantially normal to the base and a collapsed condition on the base, each said side panel being folded to or from its erect condition without any bodily lifting movement thereof, each said corner post having a height such that when said gates and panels are in their collapsed condition on top of the base, the upper ends of the corner posts project above the level of the uppermost folded down horizontal panel, a projection fixedly secured to and projecting upwardly from the upper end of each said corner post, each said projection being arranged to engage and locate a corresponding bottom corner portion of the support base of an adjacent container when stacked there-on-top, wherein each said side panel is provided adjacent each of its two bottom corners with recess means shaped and dimensioned so as to allow the side panel to swing upwardly about its said horizontal axis, unobstructed by the projection on the corner posts, to a fully erect condition, without any interengagement of said spigot means and said recess means.

Preferably each of the projection means comprises a V-shaped metal plate member having a pointed upper end, the lower edge of said V-shaped member being secured to a planar base plate which extends between the flanges of the stub corner post and is fixedly secured along the upper edges thereof.

Preferably each of the recess means is defined by an opening in the panel adjacent a bottom corner thereof.

Preferably, with the side panel in its erected condition, a peripheral edge surface portion of said opening is contiguous with an edge surface of the mounting base of the projection, whereby any outward loading on the side panel is resisted by abutting contact between the peripheral edge surface portion and an edge surface of the base.

Preferably, each of the side panels is hingedly connected with respect to the support base by means of a pair of transverse pivot pins or bolts projecting from opposite sides thereof at its lower corners, the pivot pins or bolts extending through respective holes formed in opposed, facing flanges of the stub corner posts. Alternatively, the pivot pins may engage in a pair of U-shaped saddles, one of which is inverted, secured to the upper edge surfaces of skirting walls extending along opposite sides of the pallet base.

Preferably, the front and/or rear gates are detachably connected to the support base by means of support mountings which permit the gates to be bodily lifted upwardly to disengage from the mountings.

Preferably each upper corner of each said side panel is provided with a respective said projection to thereby allow interstacking of containers when in their erected condition.

In order to more fully explain the present invention, an embodiment is described hereunder in some further detail with reference to the accompanying drawings wherein.

Figure 1:
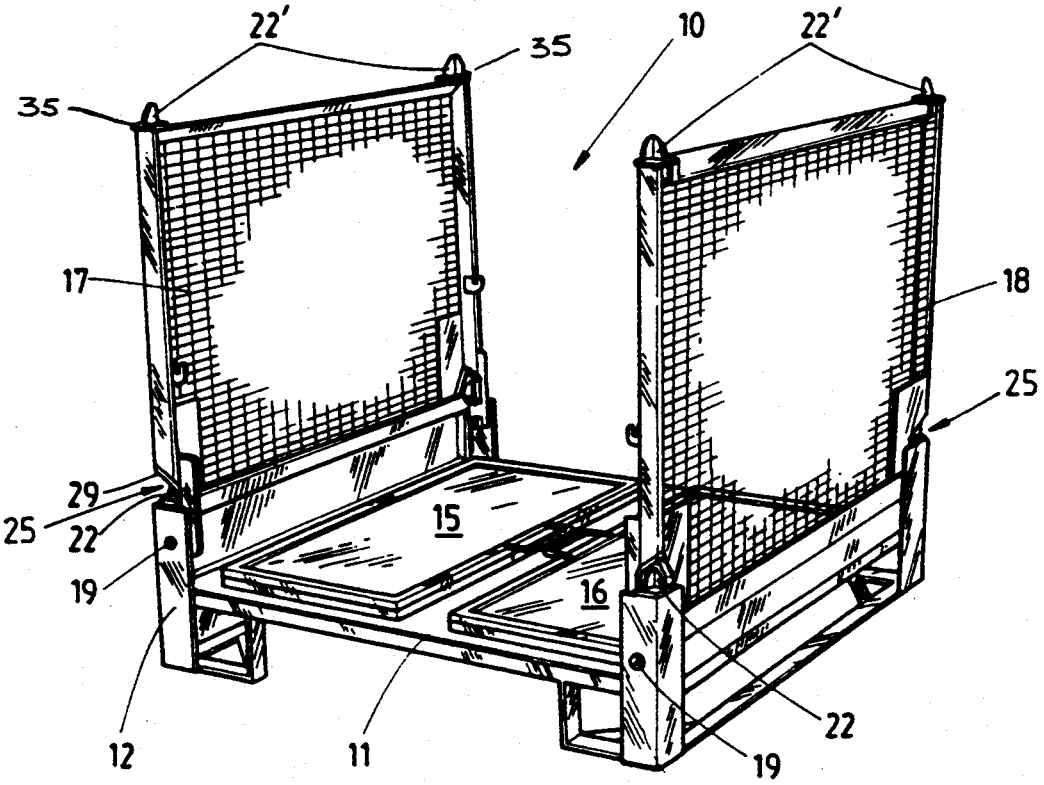
FIG. 1 is a perspective view of a collapsible storage container showing the front and rear gates laying flat on top of the support base and the side panels in their erect positions.
Figure 3:
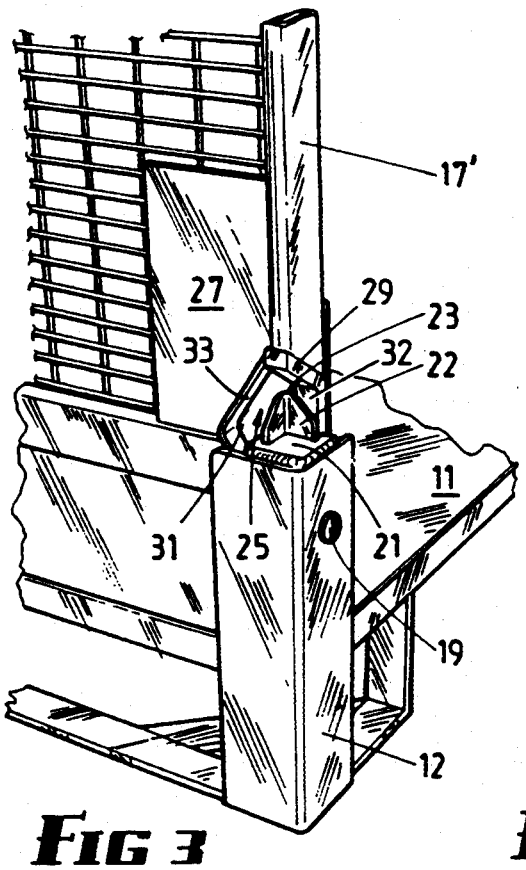
FIG. 3 is a fragmentary perspective view of that portion of the container shown in FIG. 2, but with the side panel erect.
Figure 2:
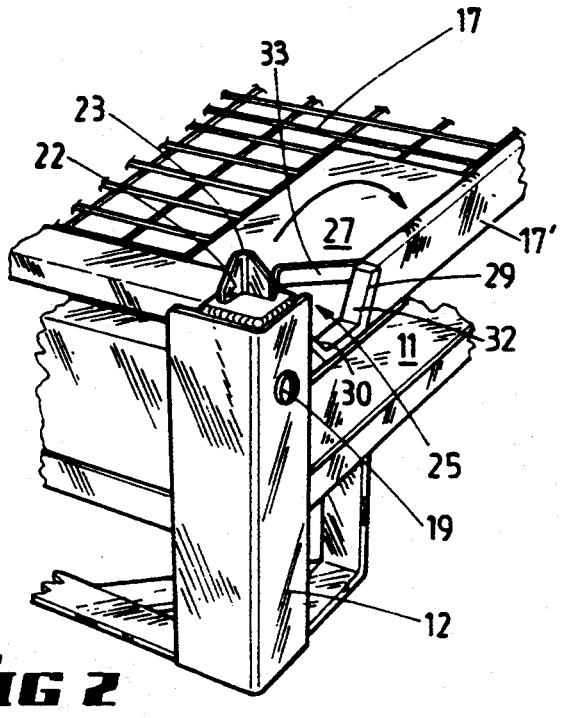
FIG. 2 is a fragmentary plan view of a corner section of the support base with the side panel folded inwardly on top of the base.

In the embodiment shown in FIGS. 1 to 3, there is shown a collapsible storage pallet container or cage 10 having a rectangular pallet with support base 11 which is provided at each of its four corners with stub corner posts 12 of angle section, the support base 11 having an horizontal sheet metal floor supported by an upper deck which in turn is supported by a lower deck by vertical uprights and also the stub corner posts 12. Front and rear gates 15, 16, respectively, are removably mounted on the pallet base 11 by means of mountings (not shown) which enable each gate to be physically lifted upwardly by a small vertical distance whereupon it can then be laid inwardly on top of the base 11. Alternatively, the front and rear gates may be pivotally mounted by pivot pins engaging in holes formed in the corner posts so that they can swing between erect and collapsed positions.

Each side panel 17, 18 is pivotally connected between a pair of stub corner posts 12 by means of pivot pins or bolts 19, the horizontal pivot axis of one side panel being slightly below the pivot axis of the other side panel. The panels 17, 18 can be folded inwardly, without having to bodily lift same, onto the base 11 so as to lie flat on top of one another. In this embodiment each of the side panels 17, 18 comprises a peripheral tubular metal frame to which is secured a metal mesh infill panel located on the outside of the tubular frame members. Each of the side panels 17, 18 is a one-piece panel whilst the front and rear gates are divided horizontally into two halves which are hinged together to permit the two halves to hinge relative to one another so as to lie approximately flat one on top of the other. A top or lid panel can be provided and which, when in place, rests on the top edges of the side panels and the front and rear gates.

As shown in FIGS. 2 and 3, each of the stub corner posts 12 is provided with locating means 22 at its upper end, the locating means 22 being secured to a metal base plate 21 bridging the flanges of the corner post 12 and secured thereto, e.g. by means of welding. The locating means 22 comprises a projection or spike extending upwardly from the base plate 21, the projection 22 in this embodiment comprising a V-shaped member of metal plate having a pointed or spear shaped tip 23. The projections 22 are configured so as to engage and locate corresponding bottom corner portions of the support base of an adjacent container when stacked there on top. In this way the containers 10 can be interstacked when in their collapsed condition. By locating the projections 22 on top of the corner posts 12, there is no interference between the spigots and the container load when the container is in use. The spigots do not intrude into the loading space of the container.

To enable the containers 10 to be stacked when in their erected condition, each of the side panels 17, 18 is provided with a pair of similar projections 22' at its upper corners. The projections 22', when the container is erected, are vertically aligned with corresponding projections 22 on the corner posts 12.

So that the side panels 17, 18 can be freely swung upwardly to their erect condition, openings or recesses 25 are provided adjacent the lower corners of the panels, the openings 25 being shaped and dimensioned to allow the panels 17, 18 to reach their fully erect positions without obstruction from the projections 22 on the corner posts 12.

As shown in FIGS. 2 and 3, each of the panels 17, 18 has a rectangular metal plate insert 27 secured, e.g. by welding, at each of the bottom corners thereof. The insert is produced by a simple stamping and cutting operation. The insert 27 is formed with a cut-away portion 31 which is bordered by a bent reinforcing metal strip 33 for strength. A further cut-away or recessed portion 32 is formed in the vertical side frame member 17' of the panel 17 and which together with the cut-away portion 31 forms the opening 25. A U-shaped bridging metal strap 29 which lies in a plane at right angles to the plane of the insert 27, borders the recessed portion 32 and connects at its ends to the ends of the strip 33.

The wall surface 30 of the strap 29, when the side panel 17 or 18 is erect, makes abutting contact with an edge of the base plate 21 of the associated projection 22, whereby any outward loading forces applied to the side panels 17, 18 is resisted by the plate 21. This enhances the overall rigidity of the panels 17, 18 when erect.

As shown in FIG. 1, each projection 22' has its base plate 35 positioned to lie slightly proud of the upper edge surface of the side panel 17, 18. This allows the base of an upper container, when stacked there on top, to bear (at its corners) against the four base plates of the projections 22' rather than resting against peripheral frame members of the lid panel of the lower container which may sometimes be fitted to the containers. The possibility of damage to the lid panel is thereby avoided.

Figure 4:
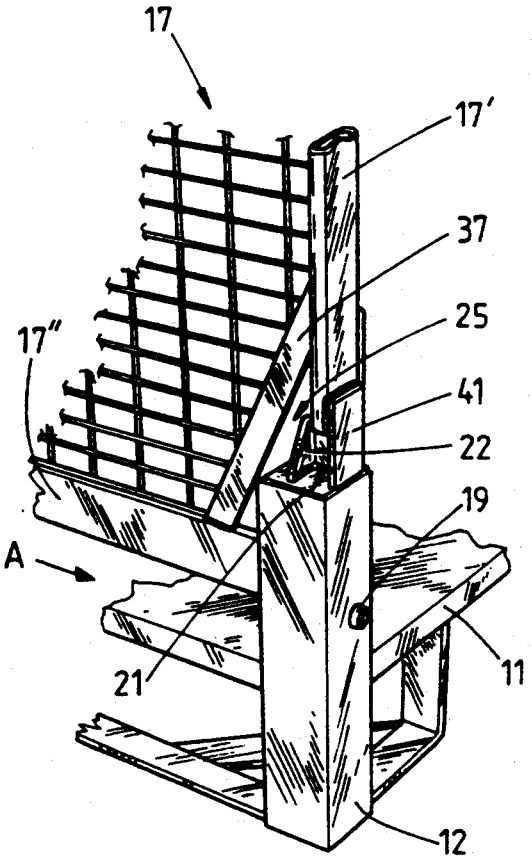
FIG. 4 is a view similar to FIG. 3 showing an alternative embodiment of the invention.
Figure 5:
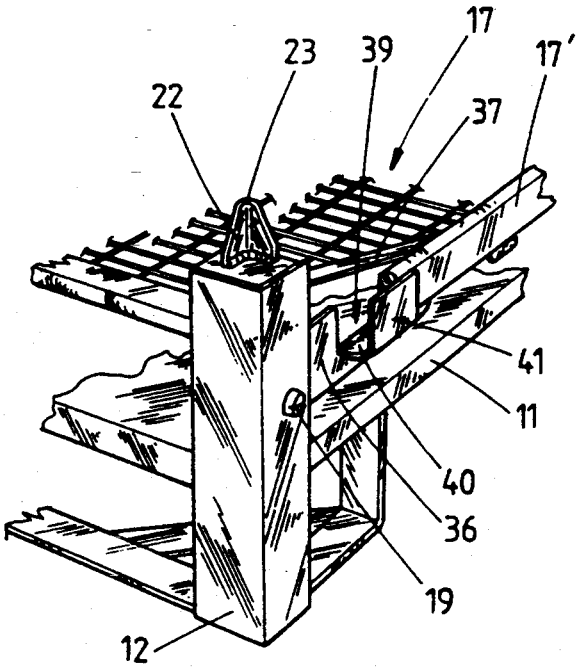
FIG. 5 is a view similar to FIG. 2 of the container shown in FIG. 4.
Figure 6:
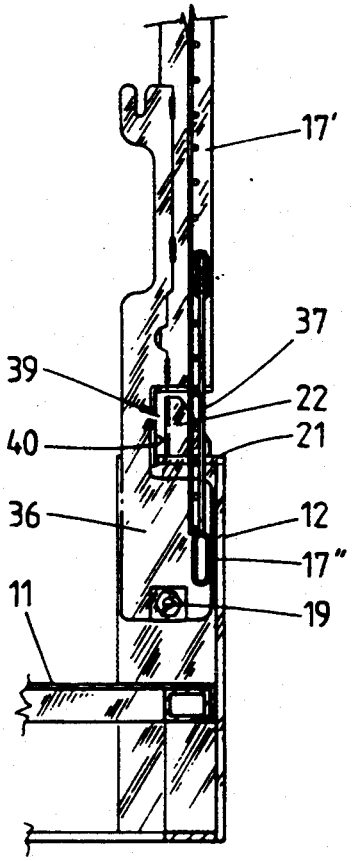
FIG. 6 is a vertical sectional view looking in the direction of arrow 'A' shown in FIG. 4.

In the embodiment shown in FIGS. 4 to 6 (where the same item numbers to those of the first embodiment are used to denote equivalent parts), each of the side panels 17, 18 is provided with a metal connector plate 36 at each of its lower corners for rigidly interconnecting the adjacent ends of the vertical and horizontal frame members 17', 17'' respectively of the panel. The connector plates 36 are also designed to locate and support the pivot pins 19 for pivotally interconnecting the panels to the stub corner posts 12. A pair of brace members 37 extend diagonally between the frame members 17', 17'' near the lower corners of the panel 17, 18, each brace member having its ends welded to the frame members, the mesh infill panel in turn being secured, by welding, along portions of its periphery, to the inner faces of the braces 37.

A recessed portion 39 formed in each of the bottom corner connector plates 36 is shaped and dimensioned to allow the panel 17 to swing upwardly from its collapsed position to an erect condition wherein the projections 22 on top of the adjacent corner posts 12 are substantially located within the confines of the recessed portions 39, with an edge of each base plate 21 in contiguous relation with wall surface 40 of the recess 39.

To further minimise possible outward deflection or bowing of the panel 17 when in an upright condition (during transportation, for example) a vertical abutment plate 41 is welded to the outer surface of each frame member 17' at its lower end and projects therefrom. When the panel 17 is fully upright, the bottom edge of the plate 41 bears against the upper surface of the base plate 21 adjacent one of its marginal edges, and effectively resists any outward loading of the panel.

It will of course be appreciated that the cutouts 25 provided at each of the bottom corners of the side panels 17, 18 may be formed in a number of different ways. For example, each corner may have an L-shaped cutout portion bordered by short length metal tubes welded to the peripheral frame members; however, this and other variations will be seen to lie within the scope of this invention.

In another variation to the abovedescribed embodiment, the rear gate is fixedly hingedly mounted to the pallet base, whilst only the front gate is removably mounted, the rear gate being a one-piece panel similar to that of the side panels.

Claims defining the invention are as follows:

1. A collapsible storage container comprising a substantially rectangular support base having a horizontal floor, a stub corner post of angle section fixed vertically at each of the four corners of the support base, front and rear gates movably mounted with respect to the support base, a pair of opposed foldable rectangular side panels each being pivotally supported between a respective pair of said corner posts for pivotal movement about a fixed horizontal axis between an erect condition substantially normal to the base and a collapsed condition on the base, each said corner post havinq a height such that when said gates and panels are in their collapsed condition on top of the base, the upper ends of the corner posts project above the level of the uppermost folded down horizontal panel;

each said corner post having a projection fixedly secured to its upper end and projecting upwardly therefrom, the projection comprising means for engaging and locating a corresponding bottom corner portion of the support base of an adjacent container when stacked there-on-top;

each said side panel having a recess adjacent each of its two bottom corners of predetermined shape and dimensions for allowing the side panel to swing upwardly about its said horizontal axis, unobstructed by the projection, to a fully erect condition, without any interengagement of said projection and said recess; and a rigid mounting plate extending horizontally between the flanges of each said stub corner post, said mounting plate being fixedly secured to the upper edges of said flanges, each said projection comprising a short length angle member secured to and projecting upwardly from the upper surface of said mounting plate.

2. A collapsible storage container according to claim 1 wherein said angle member has a pointed or spear-like upper end.

3. A collapsible storage container according to claim 1 further comprising a pair of abutment plates secured respectively to vertical peripheral frame members of each side panel adjacent the lower ends thereof and co-operating with the mounting plate to resist outward loading of the side panel when in its fully erect condition.

4. A collapsible storage container comprising a substantially rectangular support base having a horizontal floor, a stub corner post of angle section fixed vertically at each of the four corners of the support base, front and rear gates movably mounted with respect to the support base, a pair of opposed foldable rectangular side panels each being pivotally supported between a respective pair of said corner posts for pivotal movement about a fixed horizontal axis between an erect condition substantially normal to the base and a collapsed condition on the base, each said corner post having a height such that when said gates and panels are in their collapsed condition on top of the base, the upper ends of the corner posts project above the level of the uppermost folded down horizontal panel;

each said corner post having a projection fixedly secured to its upper end and projecting upwardly therefrom, the projection comprising means for engaging and locating a corresponding bottom corner portion of the support base of an adjacent container when stacked there-on-top;

each said side panel having a recess adjacent each of its two bottom corners of predetermined shape and dimensions for allowing the side panel to swing upwardly about its said horizontal axis, unobstructed by the projection, to a fully erect condition, without any interengagement of said projection and said recess; and each said recess comprising an opening in the side panel and which is bordered in part by adjacent peripheral frame members of the side panel.

5. A collapsible storage container according claim 4 wherein each said side panel is pivotally supported between a respective pair of said corner posts by horizontal pivot pins located at the lower corners of the side panel, each said pivot pin being rotatably received in a respective opening formed in a flange of a respective said corner post, said openings being dimensioned to prevent substantial vertical motion of said pins.

6. A collapsible storage container according claim 4 wherein the front gate is detachably connected to the support base by support mountings which permit the gate to be bodily lifted upwardly a short distance to disengage from said mountings, whereafter the front gate can be laid flat on the support base in its collapsed condition.

7. A collapsible storage container according to claim 6 wherein said front gate is formed in two halves which are hinged together to permit the halves to hinge relative to one another so as to be capable of lying approximately flat with one half alongside the other half, when the gate is in its fully collapsed condition.

8. A collapsible storage container comprising a substantially rectangular support base having a horizontal floor, a stub corner post of angle section fixed vertically at each of the four corners of the support base, front and rear gates movably mounted with respect to the support base, a pair of opposed foldable rectangular side panels each being pivotally supported between a respective pair of said corner posts for pivotal movement about a fixed horizontal axis between an erect condition substantially normal to the base and a collapsed condition on the base, each said corner post having a height such that when said gates and panels are in their collapsed condition on top of the base, the upper ends of the corner posts project above the level of the uppermost folded down horizontal panel;

each said corner post having a projection fixedly secured to its upper end and projecting upwardly therefrom, the projection comprising means for engaging and locating a corresponding bottom corner portion of the support base of an adjacent container when stacked there-on-top;

each said side panel having a recess adjacent each of its two bottom corners of predetermined shape and dimensions for allowing the side panel to swing upwardly about its said horizontal axis, unobstructed by the projection, to a fully erect condition, without any interengagement of said projection and said recess;

each upper corner of each said side panel being provided with upwardly projecting locating means for engaging and locating a corresponding bottom corner portion of the support base of an adjacent container when stacked there-on-top, thereby allowing interstacking of containers when in their erected condition; and each said locating means comprising an angle metal plate member having a pointed or spear-like upper end.

9. A collapsible storage container according to claim 8 wherein said angle plate member is secured to a rigid mounting plate which lies in a plane located above the upper edge surface of the side panel.

* * * * *